United States Patent [19]

Korenblit et al.

[11] 4,087,200

[45] May 2, 1978

[54] STATOR OF MULTISTAGE CENTRIFUGAL COMPRESSOR

[76] Inventors: Izya Yakovlevich Korenblit, Moskovsky prospekt, 161, kv. 46; Arkady Fridmanovich Kaplansky, ulitsa Granitnaya, 36, kv. 67; Vladimir Viktorovich Arkhipov, Zanevsky prospekt, 28, kv. 205; Andrei Filippovich Frenkel, Michurinskaya ulitsa, 21/11, kv. 7; Jury Pavlovich Sarychev, ulitsa Bukharestskaya, 27, korpus 3, kv. 134, all of Leningrad, U.S.S.R.

[21] Appl. No.: 529,950

[22] Filed: Dec. 5, 1974

[51] Int. Cl.[2] ..... F01D 1/02; F01D 9/00; F04D 29/40

[52] U.S. Cl. ..... 415/199.2; 415/219 C

[58] Field of Search ..... 415/199 A, 198, 198.1, 415/199.1, 199.2, 199.3, 501, DIG. 3, 219 C; 417/360

[56] References Cited

U.S. PATENT DOCUMENTS

| | | | |
|---|---|---|---|
| 782,273 | 2/1905 | Ray | 415/199 A |
| 984,189 | 2/1911 | Brown | 415/199 A |
| 2,633,291 | 3/1953 | Trumpler | 415/199 A |
| 2,841,087 | 7/1958 | MacMeekin et al. | 415/198 |
| 3,733,145 | 5/1973 | Kaplansky et al. | 415/199 A |
| 3,764,236 | 10/1973 | Carter | 415/501 X |

FOREIGN PATENT DOCUMENTS

| | | | |
|---|---|---|---|
| 450,053 | 1/1913 | France | 415/199 A |
| 1,528,828 | 1/1970 | Germany | 415/199 A |
| 320,874 | 5/1957 | Switzerland | 415/199 A |
| 563,532 | 8/1944 | United Kingdom | 415/199 A |

*Primary Examiner*—C. J. Husar
*Assistant Examiner*—Donald S. Holland
*Attorney, Agent, or Firm*—Steinberg & Blake

[57] ABSTRACT

A stator of a multistage centrifugal compressor, comprising a casing, stages accommodated therein and made up each of a diaphragm, a vaned diffuser and a return guide vane assembly placed one after another in the direction of flow of the medium being compressed and forming a fluid passage. The stage return guide vane assembly is rigidly fixed on the diaphragm of the next stage. The vaned diffuser of each stage is rigidly connected to the diaphragm and the stage return guide vane assembly, their joint being arranged on a diameter less than the maximum diameter of a fluid passage.

4 Claims, 1 Drawing Figure

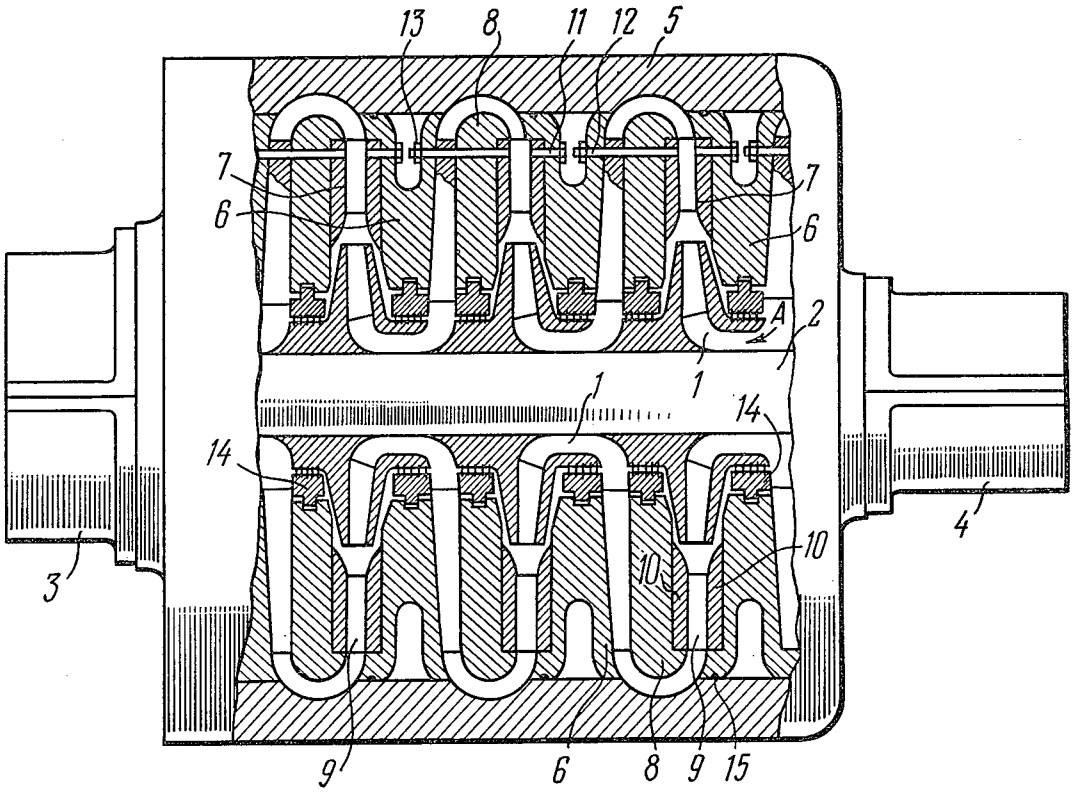
4
7
6
2
A
2
1
14
10
15
9
8
10
5
12
11
1
6
8
13
9
7
6
14
3

STATOR OF MULTISTAGE CENTRIFUGAL COMPRESSOR

FIELD OF THE INVENTION

The present invention relates to turbine machine-building and more particularly to stators for use in multistage centrifugal compressors.

Stators of such type can find favour in multistage centrifugal high-pressure compressors with vaned diffusers which have found wide application in gas and chemical industry.

DESCRIPTION OF THE PRIOR ART

Already known in the art is a stator of a multistage centrifugal compressor.

The known stator comprises a casing, stage diaphragms, stage vaned diffusers and stage return guide vane assemblies mounted in the casing one after another in the direction of the flow of medium being compressed and forming a fluid passage. The casing is split vertically. The return guide vane assembly of each stage is disposed intermediate of the stage vaned diffuser and the diaphragm of the next stage and is secured thereto. The vaned diffuser of each stage is fastened to the return guide vane assembly of the stage. To preserve the prescribed axial and radial clearances between the rotor and stator members the diaphragms of all the stages are rigidly interconnected by means of fastening members such as, for example, tie rods and nuts, arranged around the circumference. Radial dimensions of the diaphragm in each stage exceed maximum radial dimensions of the fluid passage by a value required for arranging the tie rods and nuts. This results in an increase in the inside diameter of the casing. The provision of a requisite strength of the casing involves an increase in its wall thickness. All this considerably adds to the stator metal consumption and labour input for its manufacture.

Moreover, interconnection of the stage diaphragms with the aid of fastening members does not exclude the occurence of clearances either between the stage diaphragms and vaned diffusers or between the diaphragm of a particular stage and that of the next stage. The clearances result in "leaks" of a working medium which diminishes compressor efficiency. The term "leaks" is referred to hereinbelow as the fraction of the working medium over-flowing from a higher-pressure zone into a lower-pressure zone.

Also known is a stator of a multistage centrifugal compressor. The known stator comprises a casing, stage diaphragms, stage vaned diffusers and stage return guide vane assemblies mounted within the casing one after another in the direction of the flow of medium being compressed and forming its fluid passage.

The casing has two vertical erection joints. The return guide vane assembly of each stage are arranged intermediate of the stage vaned diffuser and the diaphragm of the next stage. The return guide vane assembly of each stage is fixed on the diaphragm of the next stage with the help of bolts and nuts. The vaned diffuser of each stage is rigidly connected to the stage diaphragm. To retain the prescribed axial and radial clearances between the rotor and stator members the diaphragms of all stages are rigidly inerconnected with the aid of an additional case with slots into which the stage diaphragms are rolled. The additional case is mounted coaxially within the casing and is split horizontally. The wall thickness of the additional case is to meet the requirement of rigid fastening of the diaphragms. The use of an additional case leads to an increase in the inside diameter of the casing and of the wall thickness of the compressor casing. The known stator is noted for its high metal consumption and high labour input for its manufacture.

Moreover, the interconnection of the diaphragms with the aid of an additional case does not provide a tight joint between the stage vaned diffuser and its return guide vane assembly. A fraction of the working medium leaks from the clearance between the vaned diffuser and the return guide vane assembly of the stage, overflowing from a higher-pressure zone to a lower-pressure zone. As a result, the compressor efficiency diminishes.

It is an object of the present invention to provide a reduction in metal consumption of a compressor stator.

Another object of the invention is to increase compressor efficiency by decreasing leaks of working medium between the stator members, i.e. between a vaned diffuser and a stage diaphragm and between a vaned diffuser and a stage return guide vane assembly.

SUMMARY OF THE INVENTION

With the above-specified and other objects in view the essence of the present invention consists in that in the stator of a multistage centrifugal compressor, comprising a casing and stages mounted inside the casing and made up each of a diaphragm, a vaned diffuser and a return guide vane assembly arranged one after another in the direction of flow of working medium and forming its fluid passage, the return guide vane assembly being rigidly fixed on the diaphragm of each next stage, according to the invention, the vaned diffuser of each stage is rigidly connected to the diaphragm and the return guide vane assembly of the stage, their joint being located on a diameter which is less than the maximum diameter of the fluid passage.

This embodiment of the stator ensures rigid connection of all its members forming its fluid passage with the stator retaining its minimum radial dimensions which decreases its metal consumption and labout input for its manufacture in comparison with the above-discussed prior-art stator embodiments.

Moreover, the rigid connection between the stator members excludes leaks of the working medium between the vaned diffuser and stage diaphragm and between the vaned diffuser and the return guide vane assembly of the stage which enhances the compressor efficiency.

BRIEF DESCRIPTION OF THE DRAWING

Various other objects and advantages of the invention will become evident from the following description in which an exemplary embodiment is set forth in conjunction with the accompanying drawing, wherein:

The single FIGURE is a fragmentary sectional view of a multistage centrifugal compressor with a stator made according to the invention.

DESCRIPTION OF THE PREFERRED EMBODIMENT

A multistage centrifugal compressor comprises a rotor which constitutes stage impellers 1 mounted on a shaft 2, and a stator.

The rotor shaft 2 is mounted in a radial bearing 3 and a radial-thrust bearing 4. The stator comprises a casing 5, stage diaphragms 6, stage vaned diffusers 7 and return guide vane assemblies 8, mounted inside the casing one after another in the direction of the flow of working medium (arrow A) and forming its fluid passage.

The casing 5 has a vertical erection joint. The stator members — the stage diaphragms 6, stage vaned diffusers 7 and the return guide vane assemblies 8 of the stages are split horizontally. The stage return guide vane assembly 8 is arranged intermediate of the stage vaned diffuser 7 and the diaphragm 6 of the next stage and are secured to the diaphragms 6 of the next stage.

To provide more convenient attachment of the vaned diffuser 7 to the stage diaphragm 6 and to the stage return guide vane assembly 8 in the hereinproposed embodiment diffuser vanes 9 of the vaned diffuser 7 are rigidly connected to discs 10, e.g. by welding. In case the vaned diffuser 7 has no discs 10, the diffuser vanes 9 are secured directly to the diaphragm 6 and stage return-circuit vanes 8 by welding or brazing. The disc 10 of the vaned diffuser 7 adjoining the stage diaphragm 6 is rigidly connected to said diaphragm 6 by means of screw 11. The disc 10 of the vaned diffuser 7 adjoining the return-circuit vanes 8 is rigidly connected thereto and to the diaphragm 6 of the next stage with tie rods 12 and nuts 13.

The diaphragms 6 and return guide vane assemblies 8 are provided with seals 14, e.g. of the labyrinth type, to prevent the working medium from overflowing. The surfaces of the diaphragm 6 adjacent to the interior of the casing 5 are fitted with grooves adapted to accommodate sealing members 15, e.g. rubber rings. Thus, the diaphragms 6 of all the stages are rigidly interconnected on a diameter less than the maximum diameter of the fluid passage. At the same time no clearances are observed between the discs 10 of the vaned diffuser 7 and the adjoining surfaces of the diaphragms 6 and return guide vane assemblies 8.

The multistage centrifugal compressor is assembled as follows. The stage vaned diffuser 7 is secured with its disc 10 which is adjacent to the first diaphragm 6, in the direction of the flow of the working medium to said diaphragm 6 by means of screws 11. Next, the disc 10 of the vaned diffuser 7 adjacent to the stage return guide vane assembly 8 is secured to the return guide vane assembly 8 and the diaphragm 6 of the next in the direction of flow of the working medium stage with the aid of tie rods 12 and nuts 13; the disc 10 of the vaned diffuser 7 of the next in the direction of flow of the working medium stage adjacent to the diaphragm 6 of the next stage is fastened to this diaphragm with screws 11, etc. in all the compressor stage.

At first the lower halves of the stator members of all stages are assembled and then their upper halves, the seals 14 being placed in the diaphragms 6 and the return guide vane assembly 8. Next the shaft 2 with the stage impellers 1 is mounted in the bearings 3 and 4 and introduced into the assembled lower half of the stator members, whereupon the clearances between the seals 14 and stage impellers are checked. The assembled upper half of the stator members is set up on the lower one and fastened thereto. The rubber rings 15 are placed into the grooves of the diaphragms 6 to prevent the working medium from overflowing from one stage into another. After that a block of assembled stator member together with the rotor mounted therein is introduced into the compressor casing 5.

The above design ensures a rigid interconnection of all the stator members in the compressor fluid passage, with the stator having minimum radial dimensions. The economic effect offered by the present invention amounts to about a 15% reduction in stator metal consumption and about a 20% reduction in labour input for its manufacture and assembly.

Moreover, the rigid connection between each vaned diffuser with the diaphragm and the stage return guide vane assembly excludes overflows of the working medium between the vaned diffusers and diaphragms and the return guide vane assemblies, which enhances the compressor efficiency.

What we claim is:

1. In a multistage centrifugal compressor, a stator comprising a series of stages coaxially arranged one after the other, with each stage including in the direction of flow of the fluid which is compressed an annular diaphragm, an annular vaned diffuser, and an annular return guide vane assembly, the latter being situated between the vaned diffuser of one stage and the diaphragm of the next stage and all of said diaphragms, vaned diffusers, and return guide vane assemblies surrounding a common axis, and said vaned diffuser with the return guide vane assembly of one stage forming with the diaphragm of the next stage a group of three components, said groups of three components being situated one after the other along said axis, and a single fastening means fastening together the components of each group, so that a vaned diffuser, followed by a return guide vane assembly and the latter followed by a diaphragm are all connected together by one fastening means, while the next group of three components are fastened together by a second fastening means, and so on, and an additional fastening means fastening each vaned diffuser to the diaphragm of the preceding group.

2. The combination of claim 1 and wherein each diaphragm is formed with a recess receiving portions of both fastening means.

3. The combination of claim 2 and wherein each vaned diffuser includes a pair of discs one of which is situated next to the following return guide vane assembly and is fixed to the latter as well as the following diaphragm by said first mentioned fastening means while the other disc is fixed by the second fastening means to the preceding diaphragm.

4. The combination of claim 3 and wherein all of said fastening means are coaxially arranged and extend parallel to the common axis surrounded by said groups of components, and all of said fastening means being spaced one from the next.

* * * * *